US005701610A

United States Patent [19]

Hsu

[11] Patent Number: 5,701,610

[45] Date of Patent: Dec. 30, 1997

[54] SPORT CAP

[76] Inventor: Wen-Chung Hsu, No.250-31, Lin 15, Chung-San Tsung, Ren-Der Hsiang, Tainan Hsien, Taiwan

[21] Appl. No.: 798,600

[22] Filed: Feb. 11, 1997

[51] Int. Cl.[6] ..... A42B 3/04

[52] U.S. Cl. ..... 2/425; 2/7; 2/195.1; 2/195.7; 2/209.7

[58] Field of Search ..... 2/7, 175.1, 195.1, 2/195.7, 209.3, 209.7, 410, 425, 171, DIG. 1

[56] References Cited

FOREIGN PATENT DOCUMENTS 2487645 2/1982 France ..... 2/410

*Primary Examiner*—Diana Biefeld

[57] ABSTRACT

A sport cap includes a body, eyelets respectively in a front and a rear portion, an eyelet in the top, drop-shaped air holes around the top eyelet, a protector respectively extending down from a right and a left side of the body, an opening formed just behind each protector, and a protective peripheral edge formed along a peripheral lower side of the body.

1 Claim, 4 Drawing Sheets

SPORT CAP

BACKGROUND OF THE INVENTION

This invention concerns a sport cap, particularly having a front visor, a projecting edge in a rear lower side, and a right and a left side of body formed to curve outward to have a beautiful appearance, and able to protect the head of a wearer with a protective peripheral edge.

A known conventional sport cap shown in FIGS. 1 and 2, includes an egg-shaped body 1, two round eyelets 10 respectively in a front and a rear portion of the body 1, a round hole 11 formed in the top, a plurality of drop-shaped air holes 12 spaced around the round hole 11, a curved-down protector 13 formed in a right and a left lower side of the body 1, an curved-up opening formed just behind the protector 13 for an ear of a wearer to expose out.

However, the conventional sport cap has not any protective edges for protecting the head of a wearer, nor a visor for preventing rain from falling on the face of a wearer so that rain may flow on the eyes of the wearer to get vision of the eyes blurred in case of rain. Besides, the conventional sport cap does not have a beautiful appearance.

SUMMARY OF THE INVENTION

The purpose of the invention is to offer a sport cap provided with a protective peripheral edge for protecting the head of a wearer, and with a beautiful appearance.

The main feature of the invention is a front visor extending forward from a body, a little-bent edge along a rear portion lower edge of the body, and a peripheral protecting edge along the lower side of the body.

BRIEF DESCRIPTION OF DRAWINGS

This invention will be better understood by referring to the accompanying drawings, wherein.

DESCRIPTION OF THE PREFERRED EMBODIMENT

Figure 1:
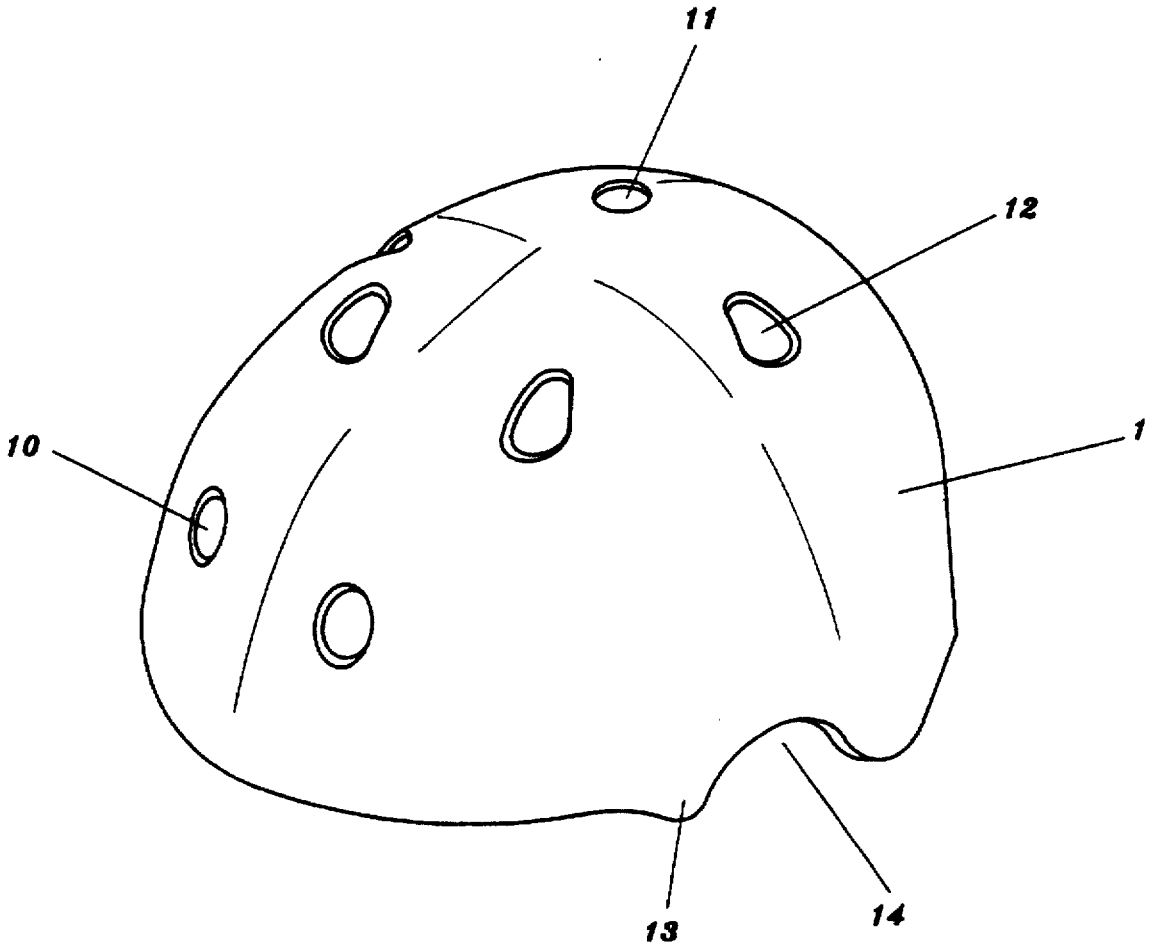
FIG.1 (PRIOR ART)
FIG. 1 is a perspective view of a known conventional sport cap.
Figure 2:
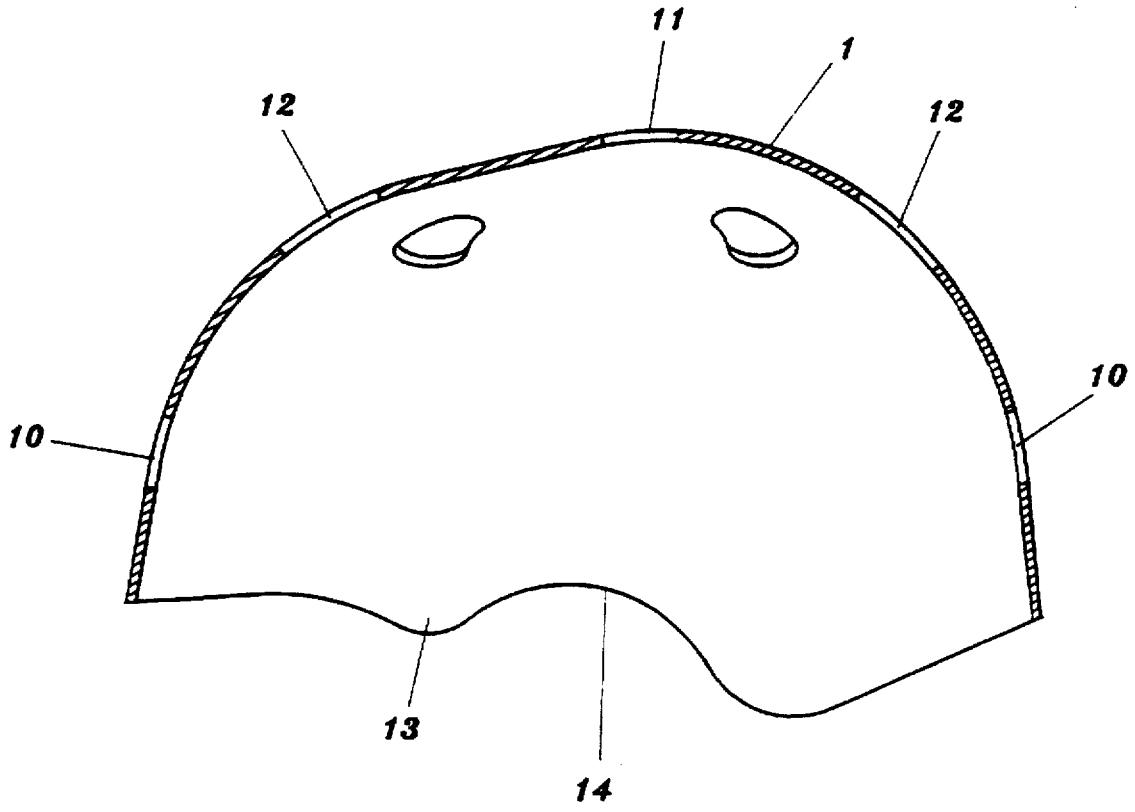
FIG. 2 (PRIOR ART)
FIG. 2 is a cross-sectional view of the conventional cap.
Figure 3:
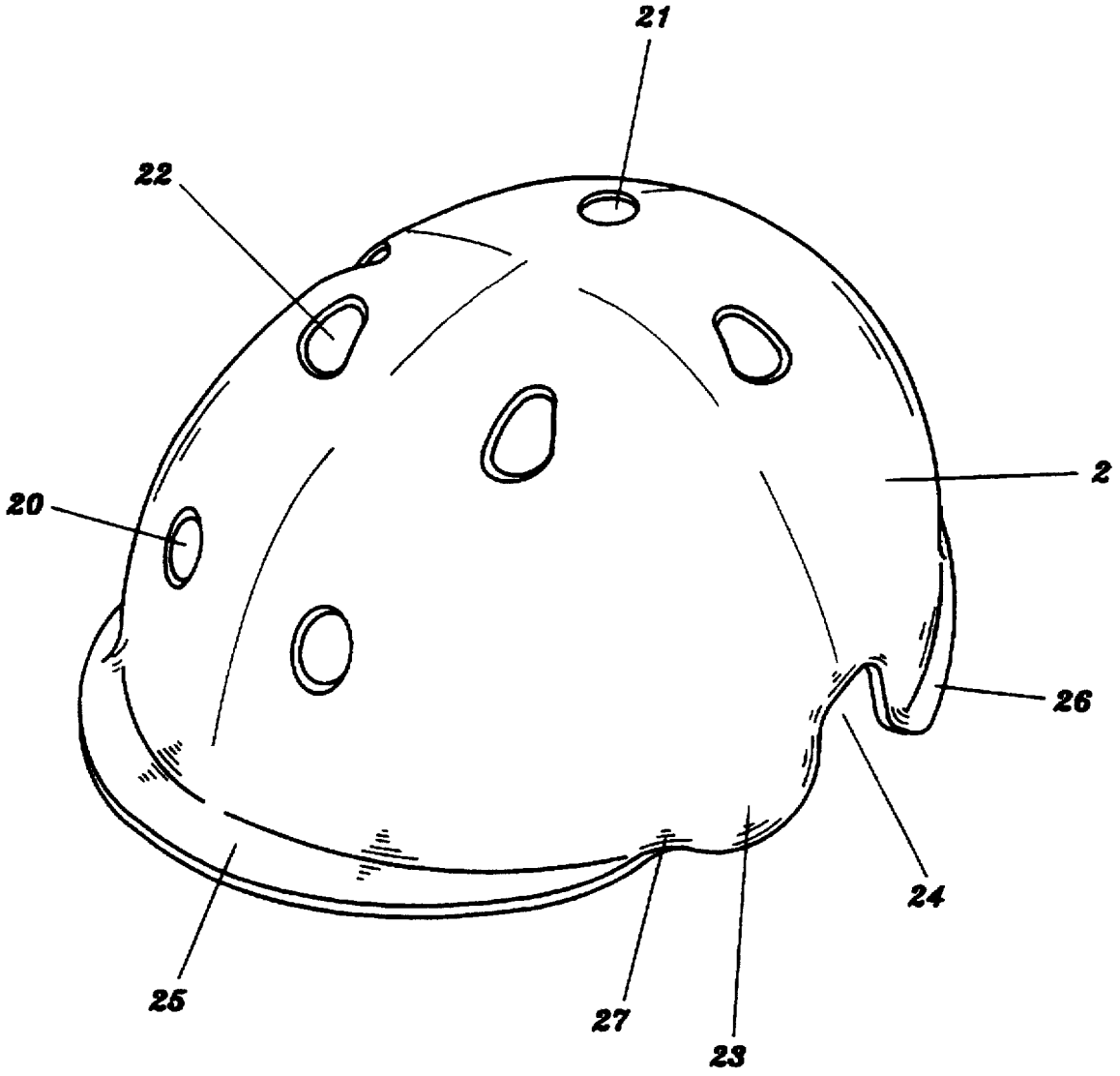
FIG. 3 is a perspective view of a sport cap in the present invention.
Figure 4:
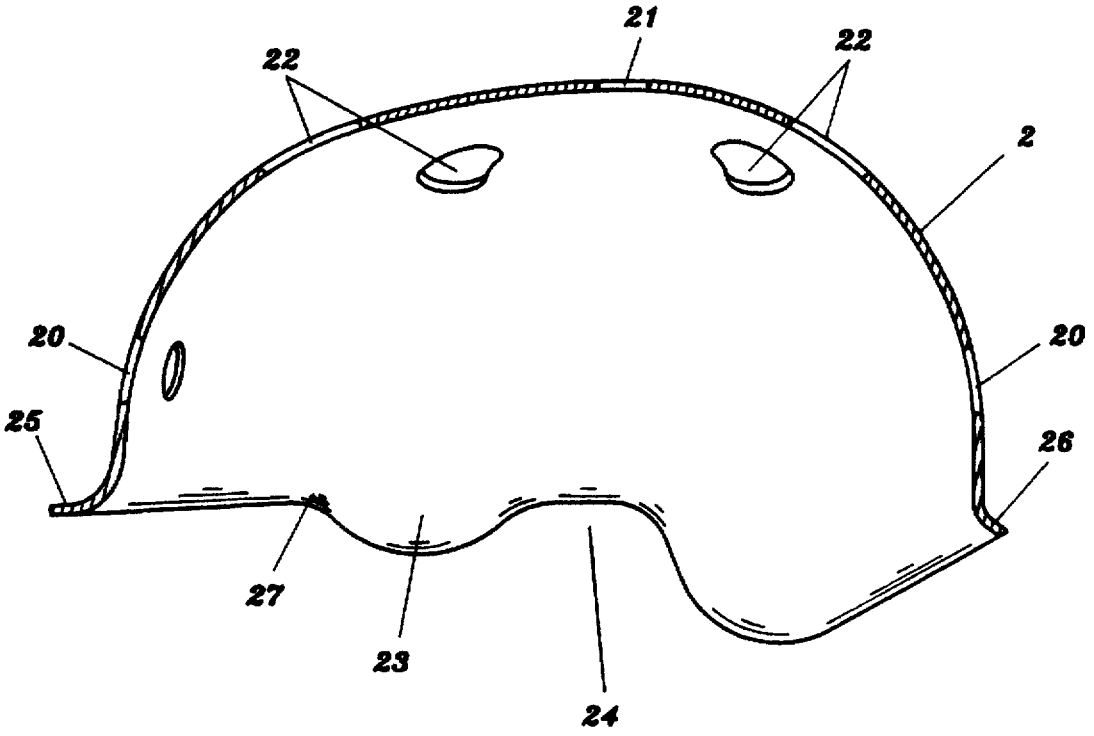
FIG. 4 is a cross-sectional view of the sport cap in the present invention.

A preferred embodiment of a sport cap in the present invention, as shown in FIGS. 3 and 4, includes an egg-shaped body 2, two round eyelets 20 properly spaced apart respectively in a front and a rear portion of the body 2, a round eyelet 21 in a top, a plurality of drop-shaped air holes 22 spaced around the round eyelet 21, a curved protector 23 formed respectively to extend down a little in a right and a left lower side, an opening 24 formed just behind each curved protect 23 for an ear of wearer to expose out of the body 2 so as not to be compressed by the body 2. Further, the body 2 has a front visor 25 extending forward, a lower bent edge 26 along the rear portion lower side, and a protective edge 27 formed along a peripheral lower side of the body 2.

In using the sport cap according to the invention, the protective edge 27 protects the head and the face of a wearer, not directly hit, when the head receives shock hitting. The front visor 25 can prevent rain from falling on the face or on the eyes as to hinder sight in case of rain. The design of the sport cap not only has a good protective effect for the head of a wearer, but also a beautiful appearance so that a wearer will feel realistic and beautiful, and have good effect for sight.

While the preferred embodiment of the invention has been described above, it will be recognized and understood that various modifications may be made therein and the appended claims are intended to cover all such modifications which may fall within the spirit and scope of the invention.

What is claimed is:

1. A sport cap comprising: a body; a plurality of eyelets formed respectively in a front portion and in a rear portion of said body; a top eyelet in a top of said body; a plurality of air holes in said body located in a spaced array around said top eyelet; a protector formed respectively in a right and a left side of said body projecting downwardly from said body; an opening formed adjacent to a rear of said protectors; a front visor extending forward from said body; a bent edge formed along a curved side of said rear portion of said body; and a protective edge formed along a lower periphery of said body.

* * * * *